US009138036B2

(12) United States Patent
Andreasson et al.

(10) Patent No.: US 9,138,036 B2
(45) Date of Patent: Sep. 22, 2015

(54) MODULAR ZIPPER BAG

(75) Inventors: Joakim Andreasson, New York, NY (US); Robert Cordero, New York, NY (US)

(73) Assignee: Bamin Inc, New York, NY (US)

( * ) Notice: Subject to any disclaimer, the term of this patent is extended or adjusted under 35 U.S.C. 154(b) by 701 days.

(21) Appl. No.: 13/163,233

(22) Filed: Jun. 17, 2011

(65) Prior Publication Data

US 2012/0255658 A1 Oct. 11, 2012

Related U.S. Application Data

(63) Continuation-in-part of application No. 13/081,199, filed on Apr. 6, 2011, now abandoned.

(51) Int. Cl.

| | |
|---|---|
| ***A45C 13/08*** | (2006.01) |
| ***A45C 5/08*** | (2006.01) |
| ***A45C 7/00*** | (2006.01) |
| ***A45C 9/00*** | (2006.01) |
| ***A45C 13/10*** | (2006.01) |

(52) U.S. Cl.

CPC ..... *A45C 5/08* (2013.01); *A45C 7/0059* (2013.01); *A45C 9/00* (2013.01); *A45C 13/08* (2013.01); *A45C 13/103* (2013.01)

(58) Field of Classification Search

CPC ..... A45C 13/00

USPC ..... 150/108; 383/4, 13, 24, 31; 190/903, 190/107

See application file for complete search history.

(56) References Cited

U.S. PATENT DOCUMENTS

| | | | | |
|---|---|---|---|---|
| 2,254,578 | A * | 9/1941 | O'Brien | 190/107 |
| 2,635,664 | A | 4/1953 | Cohen | |
| 3,994,372 | A * | 11/1976 | Geller et al. | 190/107 |
| 4,805,748 | A | 2/1989 | Gerch | |
| 6,296,094 | B1 * | 10/2001 | Knecht | 190/107 |
| 7,086,437 | B1 * | 8/2006 | Michael | 150/103 |
| 7,607,461 | B2 * | 10/2009 | Pace et al. | 150/105 |
| 2005/0021599 | A1 | 1/2005 | Peters | |
| 2005/0108495 | A1 | 5/2005 | McKenney et al. | |
| 2005/0203809 | A1 | 9/2005 | Stone et al. | |
| 2006/0078231 | A1 * | 4/2006 | Limber | 383/4 |

FOREIGN PATENT DOCUMENTS

| | | | |
|---|---|---|---|
| JP | 2004236774 | * | 8/2004 |
| JP | 2005245833 | * | 9/2005 |
| JP | 2006314773 | * | 11/2006 |
| WO | 2010097670 A1 | | 9/2010 |

* cited by examiner

*Primary Examiner* — Tri Mai

(74) *Attorney, Agent, or Firm* — Wiggin and Dana LLP; Gregory S. Rosenblatt; Jonathan D. Hall

(57) ABSTRACT

A modular bag system has components for constructing a carrying bag of a variable, customized shape. The bag includes a main body and side gusset panels. The main body has edges provided with zippers. Two lateral edges are approximated to form a tube; at least part of the outer edge of each side gusset panel has a zipper for joining to the ends of the tube. The bag may also include a handle piece provided with a zipper for joining to the main body. The side gusset panels each have a round shape, a substantially square shape, an oblong shape, or a trapezoidal shape, for forming a duffel/gym bag, an overnight/weekender bag, a briefcase/portfolio, or a tote bag, respectively.

5 Claims, 5 Drawing Sheets

MODULAR ZIPPER BAG

CROSS-REFERENCE TO RELATED APPLICATIONS

This application is a continuation-in-part of U.S. application Ser. No. 13/081,199, filed Apr. 6, 2011 now abandoned, the entire disclosure of which is incorporated herein by reference.

FIELD OF THE DISCLOSURE

This disclosure relates to luggage with modular components, and more particularly to a modular zippered bag with a variety of possible shapes, which accordingly may be adapted to a variety of uses.

BACKGROUND OF THE DISCLOSURE

People leading active lives are engaged in a variety of different activities, often in the course of a single day. As a matter of practicality, convenience, and/or fashion, different activities call for different types of carrying bags. For example, a professional person may need a gym bag early in the morning; a briefcase later in the morning at the beginning of the work day; a shopping tote in the afternoon; and a weekend/overnight bag later that day. Rather than have separate carrying bags for each activity, it is desirable to reconfigure one basic item in several different ways.

It therefore is desirable to implement a system whereby a customer may easily modify the design of a carrying bag to adapt the bag to a variety of uses.

SUMMARY OF THE DISCLOSURE

The present disclosure provides a modular bag system having components which may be assembled by the user to form a carrying bag of a variable, customized shape.

According to an embodiment of the disclosure, a carrying bag includes a main body and first and second side gusset panels. The main body has first and second lateral edges and first and second longitudinal edges. The lateral and longitudinal edges are each provided with zippers. The first and second lateral edges are approximated to form a tube with opposite first and second ends; the ends are defined by the first and second longitudinal edges respectively. At least a portion of the outer edge of each side gusset panel is provided with a zipper for joining to the ends of the tube. The first and second side gusset panels each have an outer edge joined to the tube at an end thereof; at least a portion of the outer edge of each side gusset panel is joined to a longitudinal edge of the main body. The bag may also include a handle piece with a handle panel having a first edge provided with a zipper and an opposite second edge, and a handle attached to the handle panel and extending from the second edge.

In particular embodiments, the side gusset panels each have a round shape, a substantially square shape, an oblong shape, or a trapezoidal shape, for forming a duffel/gym bag, an overnight/weekender bag, a briefcase/portfolio, or a tote bag, respectively.

According to another aspect of the disclosure, a modular bag system includes a main body and two handle pieces with zippers as described above, and a set of side gusset panels each provided with a zipper around at least a portion of the circumference thereof. The set of side gusset panels includes two having a round shape, two having a substantially square shape, two having an oblong shape, and two having a trapezoidal shape.

The foregoing has outlined, rather broadly, the preferred features of the present disclosure so that those skilled in the art may better understand the detailed description of the disclosure that follows. Additional features of the disclosure will be described hereinafter that form the subject of the claims of the disclosure. Those skilled in the art should appreciate that they can readily use the disclosed conception and specific embodiment as a basis for designing or modifying other structures for carrying out the same purposes of the present disclosure and that such other structures do not depart from the spirit and scope of the disclosure in its broadest form.

DETAILED DESCRIPTION

Figure 1:
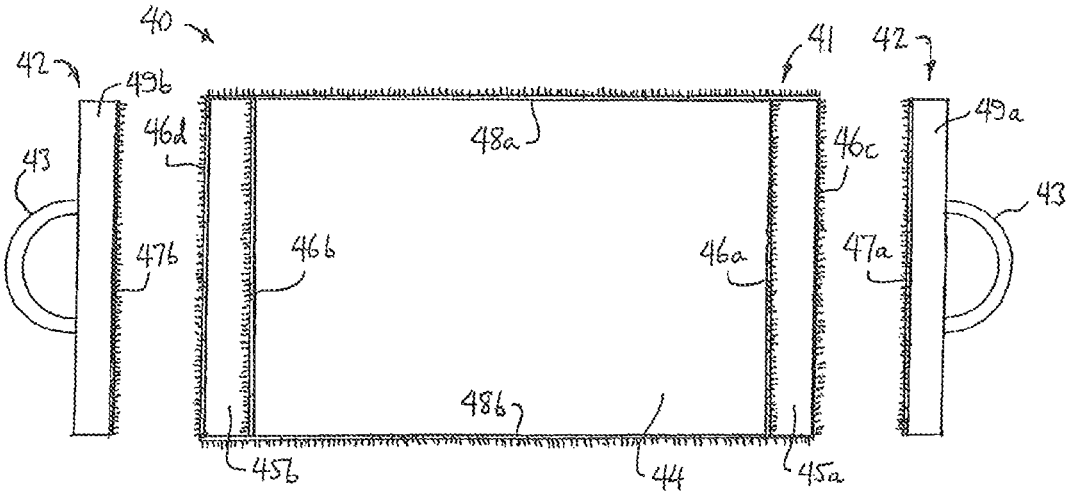
FIG. 1 is a schematic illustration in exploded view of components of a modular zipper bag system (main body and handles), according to an embodiment of the disclosure.

According to an embodiment of the disclosure, a modular zipper bag system may be configured to construct four different bag designs. Basic components (that is, components common to the various designs) of a modular zipper bag 40 are shown in exploded view in FIG. 1. As shown in FIG. 1, the bag includes a main body 41 and two detachable handle pieces 42 with handles 43. Handles 43 may be a variety of lengths, thereby enhancing the functionality of the bag; for example, a short handle as shown in FIG. 1 or a longer handle. A removable shoulder strap (not shown) may also be provided, which may be attached to handle piece 42.

The main body 41 includes three panels: a center panel 44 and end panels 45*a*, 45*b*. The panels are joined along seams having zippers 46*a*, 46*b* sewn thereto. The panels may be made of any material that permits folding the main body to form a tube, as detailed below. As shown in FIG. 1, portions 45*a* and 45*b* also have zippered edges 46*c*, 46*d* respectively at the outer ends (short edges) of main body 41. Main body 41 has long zippered edges 48*a*, 48*b*. Handle pieces 42 have handle panels 49*a*, 49*b* with zippered edges 47*a*, 47*b* respectively; handles 43 extend from edges of the handle panels opposite edges 47*a*, 47*b*.

Figure 2A:
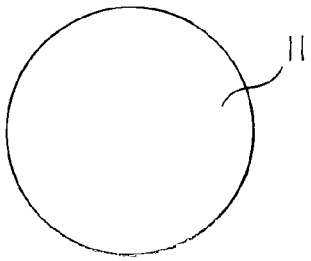
FIGS. 2A-2D are schematic illustrations of additional components of a modular zipper bag system (side gusset panels), according to an embodiment of the disclosure.
Figure 2B:
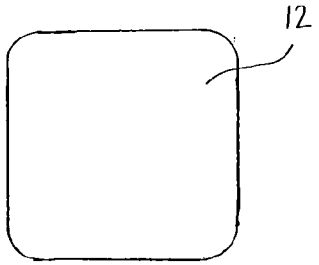
Figure 2C:
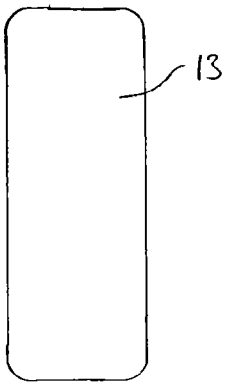
Figure 2D:
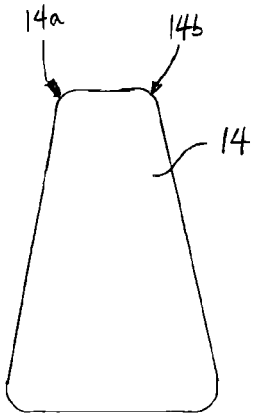

Additional components of the modular bag system, according to an embodiment of the disclosure, are shown in FIGS. 2A-2D. These components are side gusset panels of various shapes: a round panel 11 for constructing a duffel bag or gym bag (FIG. 2A); a substantially square panel 12 (in this embodiment, with rounded corners) for constructing an overnight/weekender bag (FIG. 2B); an oblong panel 13 for constructing a briefcase/portfolio (FIG. 2C); and a trapezoidal panel 14 for constructing a tote bag (FIG. 2D). The round, square and oblong panels 11-13 have zippers sewn thereto around their circumference. Since a tote bag is intended to be open at its top, the edge of panel 14 has a zipper sewn thereto only at its sides and bottom, but not at the top (between points 14*a* and 14*b*). Alternatively, panel 14 may have a zipper around its entire circumference, similarly to panels 11, 12 and 13. Furthermore, panels 11-13 may have zippers around only a portion of their circumference, so that a bag constructed with such a panel has an open top.

It will be appreciated that the side gusset panels may be provided in a wide variety of shapes, of which the four shapes in FIGS. 2A-2D are only examples. Accordingly, a carrying bag according to the disclosure may have a wide variety of configurations and thus be adapted to many different uses.

Figure 3A:
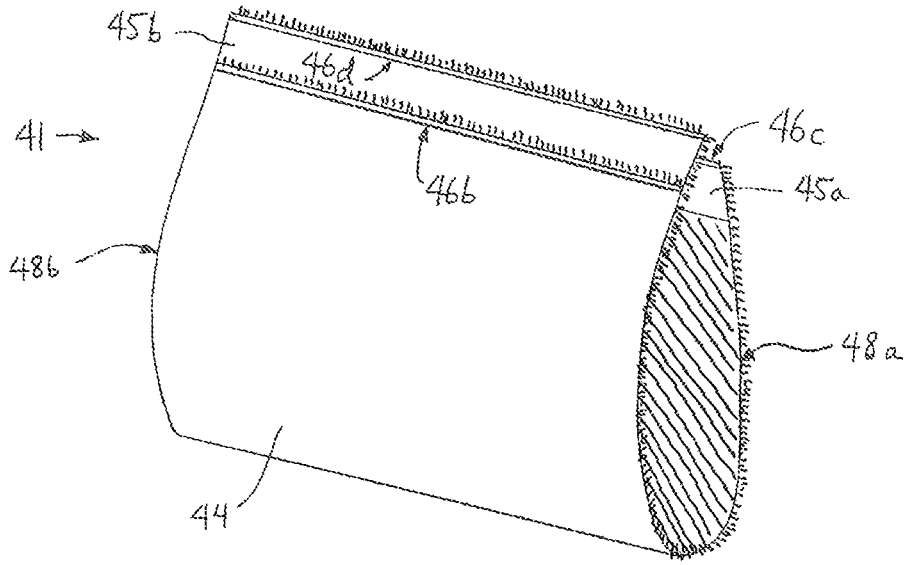
FIG. 3A schematically illustrates folding the main body of FIG. 1 to form a zipper bag.
Figure 3B:
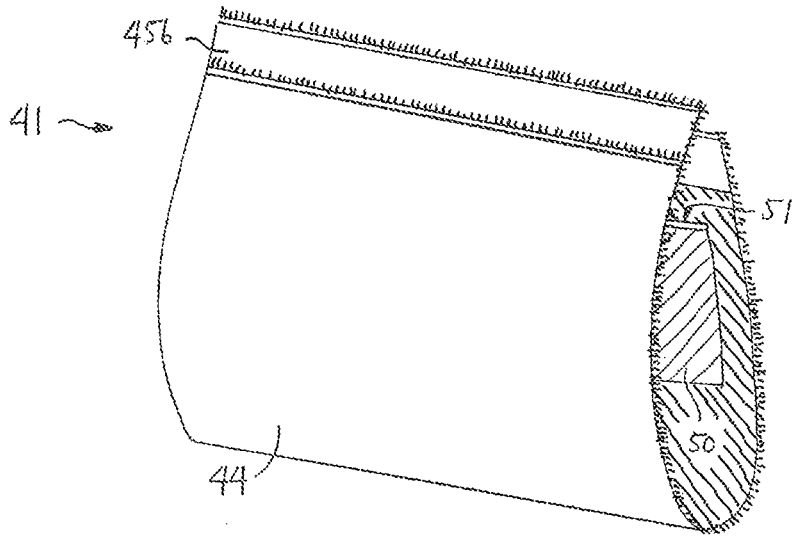
FIG. 3B schematically illustrates the folded main body of FIG. 3A, where the bag is provided with an interior pocket.

The bag is formed by folding main body 41 into a tube, approximating edge 46*c* to edge 46*d* (see FIG. 3A). In an embodiment (see FIGS. 4A and 4B), those edges are zippered together to form a tube with two opposite open ends. Comparing FIG. 1 with FIG. 3A, it may be seen that front and back sides of main body 41 become exterior and interior faces of the bag respectively. The zipper seam at 46*c*, 46*d* forms a longitudinal central zippered opening for the bag. Zippers 46*a* (not shown in FIG. 3A) and 46*b* are parallel to the central seam on either side of the bag (separated from the central seam by the width of panels 45*a*, 45*b* respectively). The zippered edges 48*a*, 48*b* of main body 41, at the open ends of the tube, join with side gusset panels of various shapes.

In an embodiment, the bag may also be reversible; main body 41 may be folded in the reverse direction, with the front and rear faces of the main body being visually distinct (e.g., different colors, decorations, printed designs, etc.). Such a reversible main body is shown in FIG. 3A by varied shading on the front and back of main body 41.

In an additional embodiment, panel 44 may have a pocket 50 sewn thereto, with a zippered opening 51. Pocket 50 may advantageously be used to store the side gusset panels that are not being used to construct the bag.

Figure 4A:
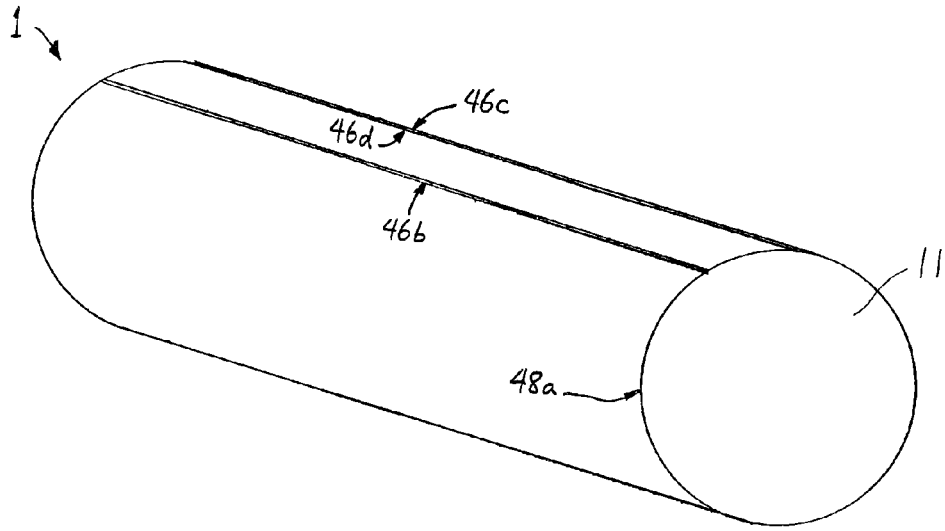
FIGS. 4A and 4B are schematic illustrations in perspective view of a modular zipper bag having a round side gusset panel.

After edges 46*c* and 46*d* are joined, edges 48*a* and 48*b* of the resulting tube are each joined to the zippered edge of the desired side gusset panel 11, 12, or 13. The resulting bag may thus be closed with round ends, closed with generally square ends, or closed with generally oblong ends (while openable via the zipper seam formed by the zippers at edges 46*c*, 46*d*). In the example of FIG. 4A, two round side gusset panels 11 are zippered to the tube to form a duffel/gym bag.

Alternatively, edges 48*a*, 48*b* of the tube may be joined to the zippered edge of side gusset panel 14, while edges 46*c*, 46*d* are held substantially parallel but not zippered together. The resulting bag is open at the top with trapezoidal ends.

Figure 4B:
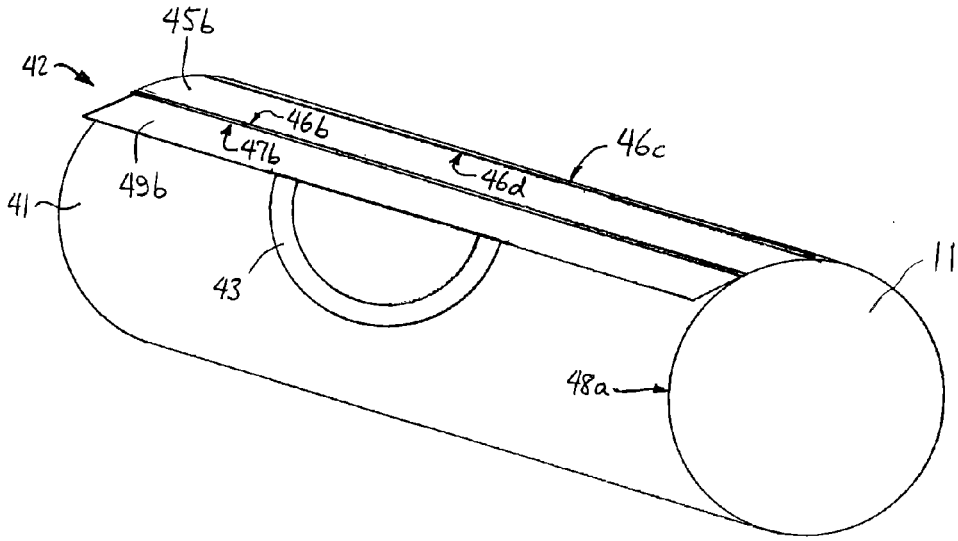
Figure 5A:
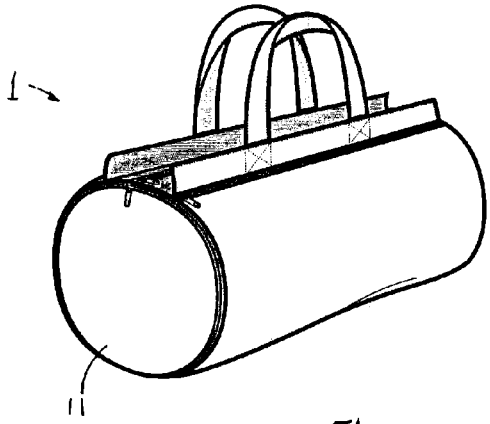
FIGS. 5A-5D illustrate in perspective view different configurations of a modular zipper bag, using the side gusset panels of FIGS. 2A-2D respectively.
Figure 5B:
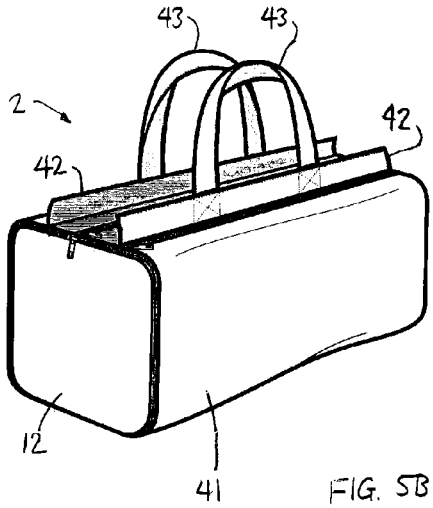
Figure 5C:
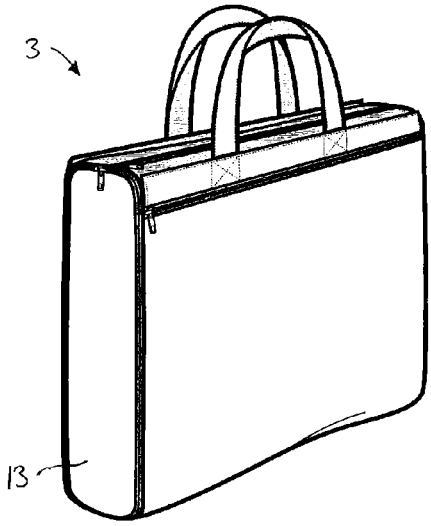
Figure 5D:
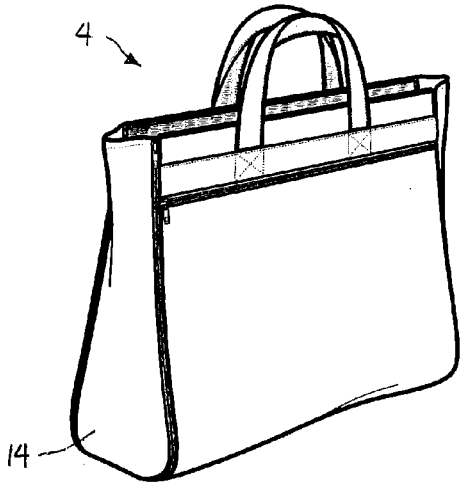

The handle pieces 42 are attached to the bag by zippering together the long edges thereof to edges 46*a* and 46*b* of panel 44. As shown in FIG. 4B, one handle piece is joined by zippering edge 46*b* to edge 47*b*, and the other handle piece (not shown in FIG. 4B) is joined by zippering edge 46*a* to edge 47*a*.

FIGS. 5A-5D illustrate finished bags in different configurations, according to embodiments of the disclosure. Duffel/gym bag 1, overnight/weekender bag 2, briefcase/portfolio 3, and tote bag 4 are constructed using side gusset panels 11, 12, 13, 14 respectively.

It will be appreciated that the modular zipper bag system may have components in various sizes and shapes, so that a wide variety of items may be configured. The components may be of a variety of materials. Additional features (e.g. shoulder straps, exterior and/or interior pockets) may also be provided, which also may include decorations as desired.

While the disclosure has been described in terms of specific embodiments, it is evident in view of the foregoing description that numerous alternatives, modifications and variations will be apparent to those skilled in the art. Accordingly, the disclosure is intended to encompass all such alternatives, modifications and variations which fall within the scope and spirit of the disclosure and the following claims.

We claim:

1. A carrying bag, comprising: a central panel, a first distal panel and a second distal panel together forming a main body having a first lateral edge and an opposite second lateral edge and a first longitudinal edge and a second longitudinal edge, the first lateral edge and the second lateral edge being approximated to form a tube with opposite first and second ends defined by the first longitudinal edge and the second longitudinal edge respectively;

a first side gusset panel having an outer edge and joined to the tube at the first end thereof, at least a portion of the outer edge of the first side gusset panel being joined to the first longitudinal edge via a single zipper slider; a second side gusset panel having an outer edge and joined to the tube at the second end thereof, at least a portion of the outer edge of the second side gusset panel being joined to the second longitudinal edge via a single zipper slider, wherein the first lateral edge, the second lateral edge, the first longitudinal edge, and the second longitudinal edge are provided with zipper teeth and at least a portion of the outer edge of the first side gusset panel and at least a portion of the outer edge of the second side gusset panel are provided with zipper teeth for joining to the ends of the tube; and a first length of attachment zipper teeth disposed between the central panel and the first distal panel and that extends substantially from the first longitudinal edge to the second longitudinal edge, and is parallel to the first lateral edge and spaced from the first lateral edge a first width;

a second length of attachment zipper teeth disposed between the central panel and the second distal panel and that extends substantially from the first longitudinal edge to the second longitudinal edge, and is parallel to the second lateral edge and spaced from the second lateral edge a second width;

a first handle piece including a handle panel having a first edge provided with a length of zipper teeth and a zipper slider and an opposite second edge provided with a handle;

a second handle piece including a handle panel having a first edge provided with a length of zipper teeth and a zipper slider and an opposite second edge provided with a handle; and wherein the length of zipper teeth of the first handle piece is removably interconnected with the first length of attachment zipper teeth via the zipper slider of the first handle piece, and the length of zipper teeth of the second handle piece is removably interconnected with the second length of attachment zipper teeth via the zipper slider of the second handle piece.

2. A carrying bag according to claim 1, wherein the first side gusset panel and the second side gusset panel each have one of a round shape, a substantially square shape, an oblong shape, and a trapezoidal shape.

3. A carrying bag according to claim 1, wherein the first side gusset panel and the second side gusset panel each have one of a round shape, a substantially square shape, an oblong shape, and a trapezoidal shape, the first lateral edge and the second lateral edge are joined by their respective zippers to form said tube, said joined zippers thereby forming a zipper seam of said tube, the outer edge of the first side gusset panel and the outer edge of the second side gusset panel are each provided with said zipper teeth around the entire circumference thereof, the zipper at the outer edge of the first side gusset panel is joined to the zipper at the first longitudinal edge around the entire circumference of the first side gusset panel, and the zipper at the outer edge of the second side gusset panel is joined to the zipper at the second longitudinal edge around the entire circumference of the second side gusset panel, thereby forming a closed bag openable at said zipper seam.

4. A carrying bag according to claim 1, wherein the main body further includes a pocket attached thereto, the pocket having a zipper along one edge thereof.

5. A carrying bag according to claim 1, wherein the main body has a front face and a visually distinct opposite rear face, thereby providing a reversible bag.

* * * * *